US009182125B2

(12) United States Patent
Leinonen et al.

(10) Patent No.: US 9,182,125 B2
(45) Date of Patent: Nov. 10, 2015

(54) FUEL PLENUM ANNULUS

(71) Applicant: General Electric Company, Schenectady, NY (US)

(72) Inventors: Brian Michael Leinonen, Anderson, SC (US); George Kalinovich, Greenville, SC (US)

(73) Assignee: General Electric Company, Schenectady, NY (US)

( * ) Notice: Subject to any disclaimer, the term of this patent is extended or adjusted under 35 U.S.C. 154(b) by 527 days.

(21) Appl. No.: 13/686,575

(22) Filed: Nov. 27, 2012

(65) Prior Publication Data

US 2014/0144149 A1 May 29, 2014

(51) Int. Cl.
*F23R 3/28* (2006.01)
*F23D 14/62* (2006.01)

(52) U.S. Cl.
CPC ..... *F23R 3/286* (2013.01); *F23D 14/62* (2013.01); *F23R 2900/00017* (2013.01); *F23R 2900/00018* (2013.01); *Y10T 29/49234* (2015.01)

(58) Field of Classification Search
CPC ..... F23R 3/286; F23R 2900/00017; F23R 2900/00018
See application file for complete search history.

(56) References Cited

U.S. PATENT DOCUMENTS

| | | | | |
|---|---|---|---|---|
| 4,100,733 | A * | 7/1978 | Striebel et al. | 60/39.463 |
| 4,845,952 | A * | 7/1989 | Beebe | 60/737 |
| 2004/0011054 | A1* | 1/2004 | Inoue et al. | 60/776 |
| 2010/0031662 | A1* | 2/2010 | Zuo | 60/740 |
| 2010/0192581 | A1* | 8/2010 | Ziminsky et al. | 60/737 |
| 2011/0083439 | A1* | 4/2011 | Zuo et al. | 60/737 |

* cited by examiner

*Primary Examiner* — Phutthiwat Wongwian
*Assistant Examiner* — William Breazeal
(74) *Attorney, Agent, or Firm* — Sutherland Asbill & Brennan LLP

(57) ABSTRACT

Embodiments of the disclosure include a combustor assembly. The combustor assembly may include one or more fuel plenums. The combustor assembly may also include one or more fuel distribution plates disposed within the fuel plenums. Moreover, the combustor assembly may include a number of mixing tubes disposed at least partially within the fuel plenums and extending through the fuel distribution plates. In certain aspects, the mixing tubes may each include a reduced diameter about the fuel distribution plates to form an annulus therebetween.

18 Claims, 4 Drawing Sheets

FUEL PLENUM ANNULUS

FIELD OF THE DISCLOSURE

Embodiments of the disclosure relate generally to gas turbine engines and more particularly to combustor fuel plenums.

BACKGROUND OF THE DISCLOSURE

In a conventional gas turbine, numerous combustors are disposed in an annular array about the axis of the gas turbine. A compressor supplies compressed air to each combustor, wherein the compressed air and fuel are mixed and burned. Hot combustion gases may flow from each combustor through a transition piece to a first stage nozzle to drive a turbine and generate power. Often, each combustor includes a fuel plenum or each nozzle in the combustor has a fuel plenum with multiple nozzles per combustor disposed therein. Typically, the fuel plenum may include various components that are machined separately and thereafter assembled. Current fuel plenum assemblies and manufacturing techniques, however, tend to produce misaligned components and/or components that must be machined with increased tolerances to ensure that they fit together, leading to increased manufacturing costs, stress on the components, and/or inefficient operation. Accordingly, improving fuel plenum assemblies and the associated manufacturing techniques continues to be a priority.

BRIEF DESCRIPTION OF THE DISCLOSURE

Some or all of the above needs and/or problems may be addressed by certain embodiments of the present disclosure. According to one embodiment, there is disclosed a combustor assembly. The combustor assembly may include fuel nozzles or sectors which contain one or more fuel plenums. The combustor assembly may also include one or more fuel distribution plates disposed within each of the fuel plenums. Moreover, the combustor assembly may include a number of mixing tubes disposed at least partially within the fuel plenums and extending through the fuel distribution plates. In certain aspects, the mixing tubes may each include a reduced diameter about the fuel distribution plates to form an annulus therebetween.

According to another embodiment, there is disclosed a fuel plenum. The fuel plenum may include a first boundary plate, a second boundary plate spaced apart from the first boundary plate, one or more fuel distribution plates disposed between the first boundary plate and the second boundary plate to form two or more fuel chambers, and an outer barrel (that may or may not be round) disposed about the first boundary plate, the second boundary plate, and the fuel distribution plates. The fuel plenum may also include a number of mixing tubes disposed at least partially within the outer barrel and extending from the first boundary plate, through the fuel distribution plates, and to the second boundary plate. In certain aspects, the mixing tubes may each include a reduced diameter about the fuel distribution plates to form an annulus therebetween.

Further, according to another embodiment, there is disclosed a method. The method may include assembling a fuel plenum comprising a first boundary plate, a second boundary plate spaced apart from the first boundary plate, and one or more fuel distribution plates disposed between the first boundary plate and the second boundary plate. The method may also include machining a number of axially concentric holes within the first boundary plate, the fuel distribution plates, and the second boundary plate. Moreover, the method may include positioning a number of mixing tubes within the concentric holes. In certain aspects, the mixing tubes may each include a reduced diameter about the fuel distribution plates to form an annulus therebetween.

Other embodiments, aspects, and features of the disclosure will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale, and wherein.

DETAILED DESCRIPTION OF THE DISCLOSURE

Illustrative embodiments will now be described more fully hereinafter with reference to the accompanying drawings, in which some, but not all embodiments are shown. The present disclosure may be embodied in many different forms and should not be construed as limited to the embodiments set forth herein. Like numbers refer to like elements throughout.

Figure 1:
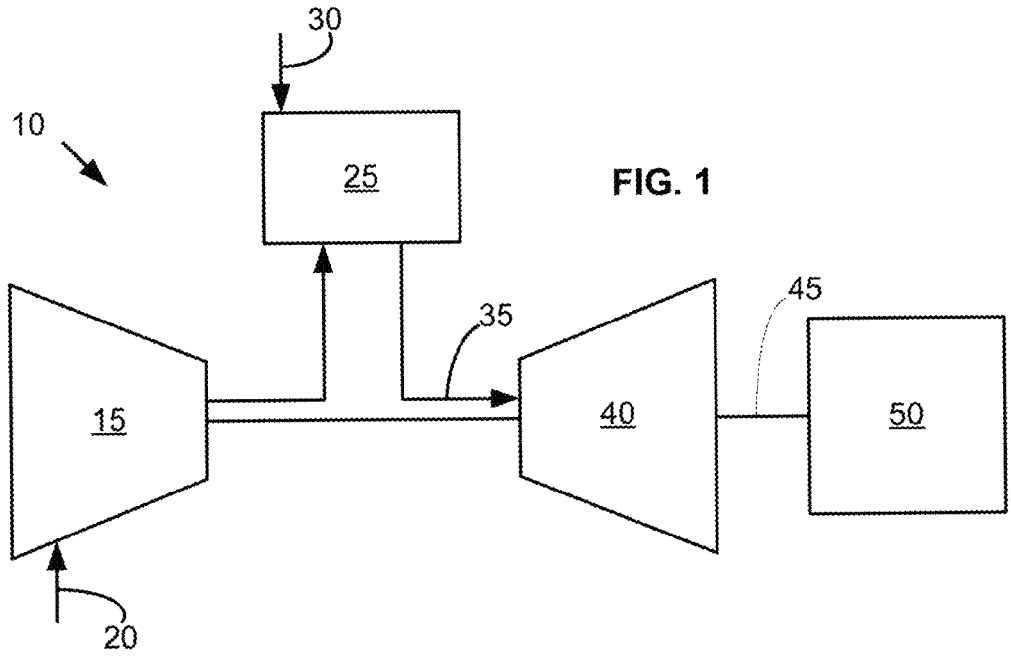
FIG. 1 is a schematic of an example diagram of a gas turbine engine with a compressor, a combustor, and a turbine, according to an embodiment.

Illustrative embodiments are directed to, among other things, combustor assemblies including fuel plenums. FIG. 1 depicts a schematic view of a gas turbine engine 10 as may be used in certain embodiments herein. The gas turbine engine 10 may include a compressor 15. The compressor 15 may compress an incoming flow of air 20. The compressor 15 may then deliver the compressed flow of air 20 to a combustor 25. The combustor 25 may mix the compressed flow of air 20 with a pressurized flow of fuel 30 and ignite the mixture to create a flow of combustion gases 35. Although only a single combustor 25 is shown, the gas turbine engine 10 may include any number of combustors 25. The flow of combustion gases 35 in turn may be delivered to a turbine 40. The flow of combustion gases 35 may drive the turbine 40 so as to produce mechanical work. In some examples, the mechanical work produced in the turbine 40 may drive the compressor 15 via a shaft 45 and/or an external load 50, such as an electrical generator or the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine or the like. The gas turbine engine 10 may have different configurations and may use other types of components. Other types of gas turbine engines may also be used herein. Further, multiple gas turbine engines, other types of turbines, and other types of power generation equipment also may be used herein together.

Figure 2:
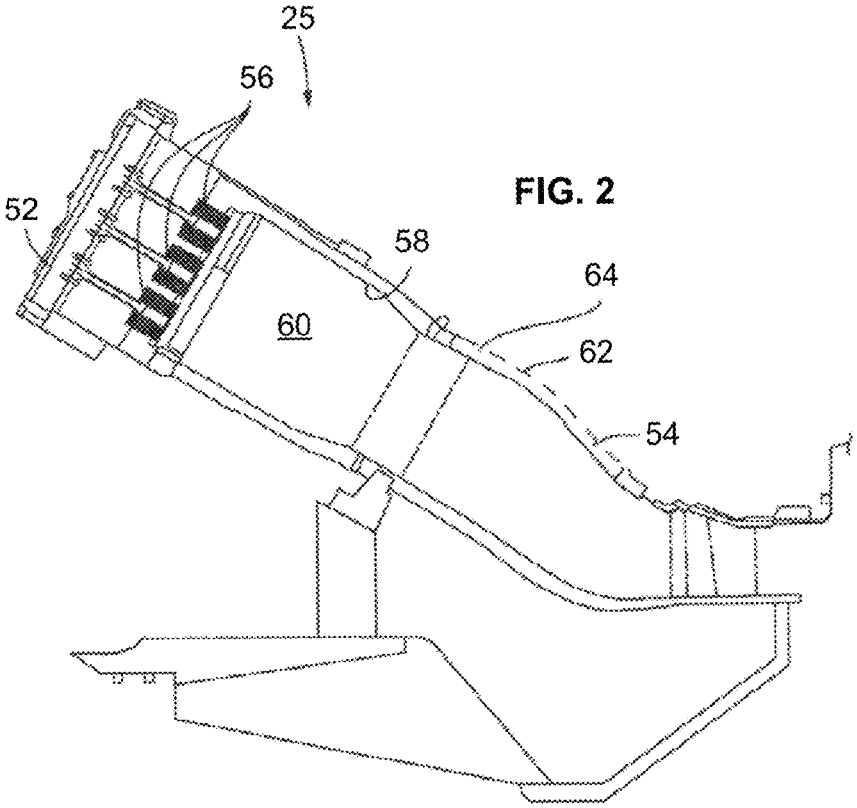
FIG. 2 is a schematic diagram of a combustor as may be used with the gas turbine engine of FIG. 1, according to an embodiment.

FIG. 2 depicts a schematic diagram of the combustor 25 as may be used with the gas turbine engine 10 described above. The combustor 25 may extend from an end cap 52 at a head end to a transition piece 54 at an aft end about the turbine 40. A number of fuel nozzles 56 may be positioned about the end cap 52. A liner 58 may extend from the fuel nozzles 56 towards the transition piece 54 and may define a combustion zone 60 therein. The liner 58 may be surrounded by a flow sleeve 62. The liner 58 and the flow sleeve 62 may define a flow path 64 therebetween for the flow of air 20 from the compressor 15 or otherwise. The combustor 25 described herein is for the purpose of example only. That is, one or more combustors with other components and/or other configurations may also be used herein.

Figure 3:
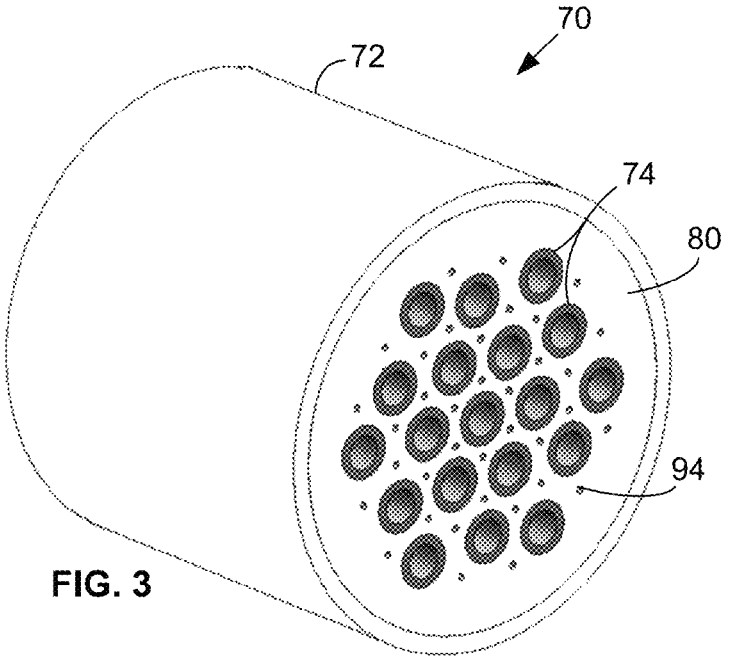
FIG. 3 is a perspective view of a portion of a micro-mixer fuel plenum as may be used in the combustor of FIG. 2, according to an embodiment.
Figure 4:
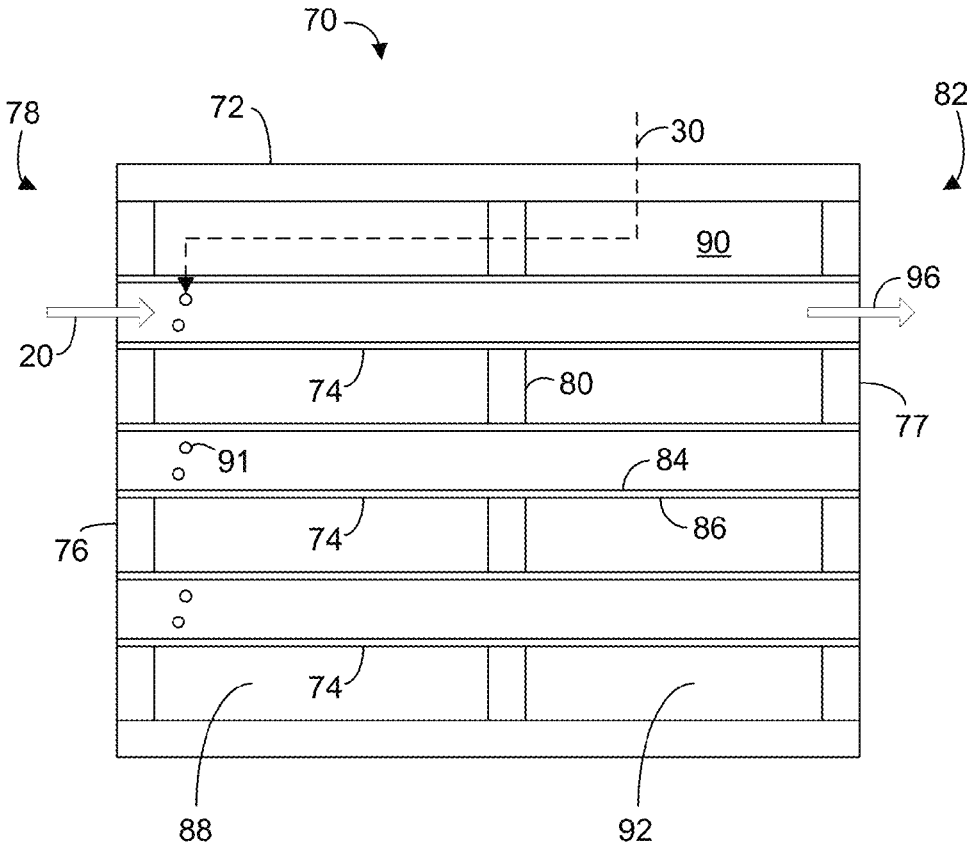
FIG. 4 is a side cross-sectional view of a portion of the micro-mixer fuel plenum of FIG. 3, according to an embodiment.

FIGS. 3 and 4 depict an example of a combustor assembly fuel plenum 70. The fuel plenum 70 may be associated with the fuel nozzles 56 or otherwise. In certain embodiments, the fuel plenum 70 may include an outer barrel 72 with a number of mixing tubes 74 at least partially disposed therein. In some examples, the mixing tubes 74 may extend from and through a first boundary plate 76 on a first end 78 of the fuel plenum 70, through a fuel distribution plate 80 disposed within the fuel plenum 70, and to and through a second boundary plate 77 on a second end 82 of the fuel plenum 70. For example, a number of axially concentric holes may be formed within the first boundary plate 76, the fuel distribution plate 80, and the second boundary plate 77. In this manner, the mixing tubes 74 may be disposed at least partially within the axially concentric holes. In some instances, the fuel distribution plate 80 may bifurcate the fuel plenum 70 into two fuel chambers. For example, a first fuel chamber 88 may be formed between the first boundary plate 76 and the fuel distribution plate 80; while a second fuel chamber 92 may be formed between the second boundary plate 77 and the fuel distribution plate 80.

Any number of the mixing tubes 74 may be used herein in varying configurations. Moreover, the outer barrel 72 and the mixing tubes 74 may have any size, shape, or configuration. Each of the mixing tubes 74 may have an inner surface 84 forming an inner diameter and an outer surface 86 forming an outer diameter. Each mixing tube 74 may also include a number of orifices 91 extending from the outer surface 86 to the inner surface 84. Any number of the orifices 91 may be used in any size, shape, or configuration. In some instances, the interstitial space between the mixing tubes 74 and/or the outer barrel 72 may define a fuel space 90 therein for the introduction of the flow of fuel 30.

In one example embodiment, as depicted in FIG. 4, the flow of fuel 30 may enter the second fuel chamber 92. The flow of fuel 30 may then pass through the fuel distribution plate 80 into the first fuel chamber 88. For example, in some instances, the flow of fuel 30 may pass through the fuel distribution plate 80 via a number of openings 94 within the fuel distribution plate 80. In other instances, as discussed in greater detail with reference to FIG. 5 below, the flow of fuel 30 may pass through an annulus formed between the fuel distribution plate 80 and the mixing tubes 74. After entering the first fuel chamber 88, the flow of fuel 30 may flow through the orifices 91 and mix with the flow of air 20 to form an air/fuel mixture 96. The air/fuel mixture 96 may then exit the mixing tube 74 about the second end 82.

Figure 5:
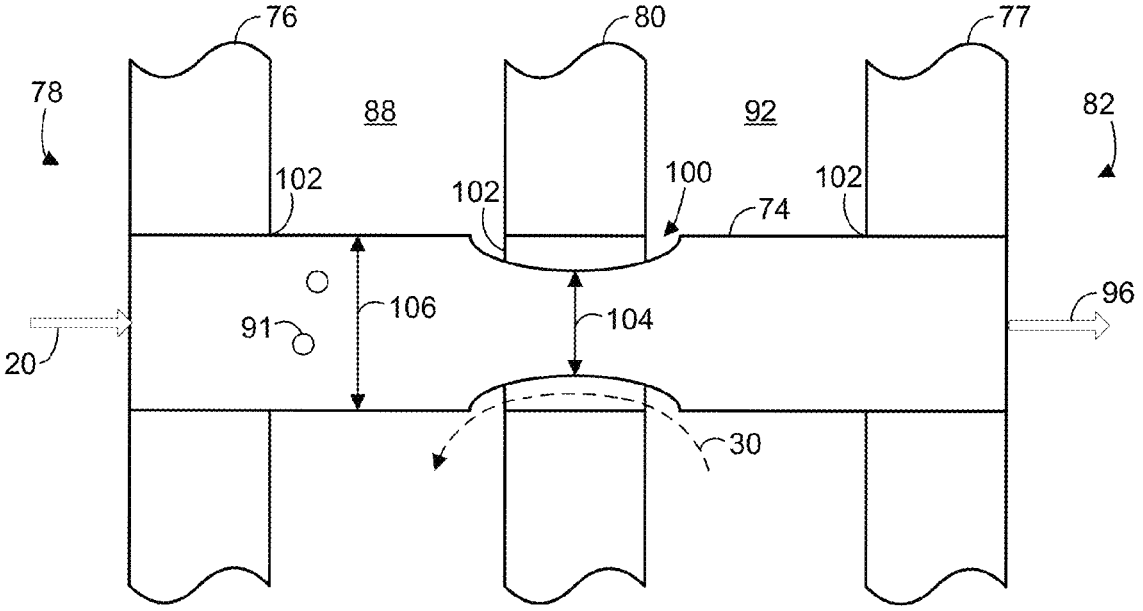
FIG. 5 is a side cross-sectional view of a portion of the micro-mixer fuel plenum of FIG. 4, according to an embodiment.

Turning now to FIG. 5, the mixing tubes 74 may each include a reduced diameter 104 about the fuel distribution plate 80 to form an annulus 100 therebetween. For example, the mixing tubes 74 may include a constant diameter 106 from the first end 78 of the fuel plenum 70 to the second end 82 of the fuel plenum 70; however, in the area about the fuel distribution plate 80, the mixing tubes 74 may include a reduced diameter 104. In certain aspects, a number of axially concentric holes 102 may be formed within the first boundary plate 76, the fuel distribution plate 80, and the second boundary plate 77. The reduced diameter 104 and the axially concentric hole 102 in the fuel distribution plate 80 may collectively form an annulus 100 therebetween. The annulus 100 may facilitate the flow of fuel 30 through the fuel distribution plate 80. That is, the flow of fuel 30 may pass from the second fuel chamber 92 to the first fuel chamber 88 (or vice versa) via the annulus 100. In certain embodiments, the inner diameter of the mixing tubes 74 may be constant from the first end 78 of the fuel plenum 70 to the second end 82 of the fuel plenum 70, while in other embodiments, the inner diameter of the mixing tubes 74 may be reduced in the area about the fuel distribution plate 80 in a similar fashion as the outer diameter 104.

Still referring to FIG. 5, in some instances of use, the flow of fuel 30 may pass through the annulus 100 formed between the fuel distribution plate 80 and the reduced diameter portion 104 of mixing tubes 74. That is, the flow of fuel 30 may pass from the second fuel chamber 92 to the first fuel chamber 88 via the annulus 100. In some examples, after entering the first fuel chamber 88, the flow of fuel 30 may flow through the orifices 91 and mix with the flow of air 20 to form an air/fuel mixture 96. The air/fuel mixture 96 may then exit the mixing tube 74 about the second end 82.

Figure 6:
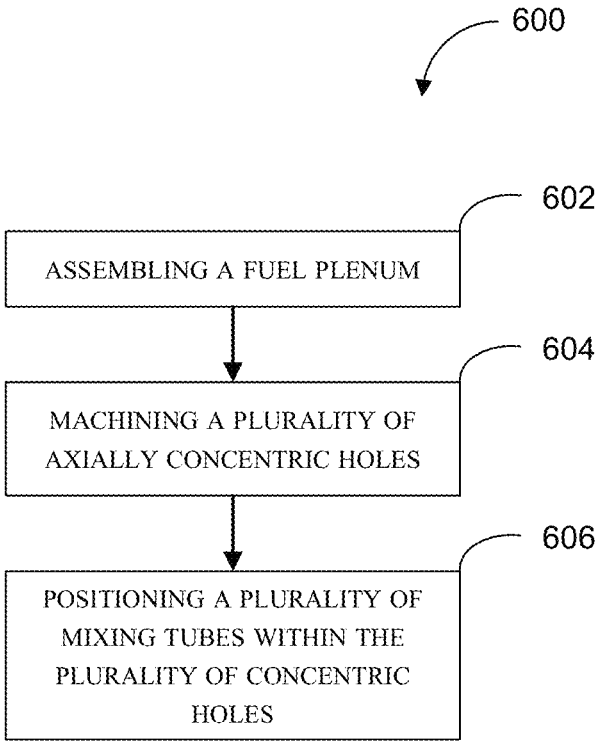
FIG. 6 is an example flow diagram of a method, according to an embodiment.

FIG. 6 illustrates an example flow diagram of a method 600 for providing an annulus 100 within a fuel plenum 70 for the flow of fuel between fuel chambers. In this particular embodiment, the method 600 may begin at block 602 of FIG. 6 in which the method 600 may include assembling a fuel plenum. For example, in some instances, the fuel plenum may include a first boundary plate 76, a second boundary plate 77 spaced apart from the first boundary plate 76, and a fuel distribution plate 80 disposed between the first boundary plate 76 and the second boundary plate 77. In this manner, these components may be assembled together to at least partially form the fuel plenum 70. At block 604, the method may include machining a number of axially concentric holes 102. For example, the axially concentric holes 102 may be machined into the first boundary plate 76, the fuel distribution plate 80, and the second boundary plate 77 at the same time using a boring technique or other machining process. In some instances, the axially concentric holes 102 in the first boundary plate 76, the fuel distribution plate 80, and the second boundary plate 77 are the same size (i.e., the same diameter). Machining the axially concentric holes 102 into the assembled first boundary plate 76, fuel distribution plate 80, and second boundary plate 77, tends to provide reduced variability in the alignment and size of the concentric holes 102, leading to improved fuel distribution, reduced strain on the fuel plenum, and reduced manufacturing costs.

Moreover, at block 606, the method 600 may include positioning a number of mixing tubes 74 within the concentric holes 102. In certain aspects, the mixing tubes 74 may each include a reduced diameter 104 about the fuel distribution plate 80. For example, the mixing tubes 74 may include a constant diameter 106 from the first end 78 of the fuel plenum 70 to the second end 82 of the fuel plenum 70; however, in the area about the fuel distribution plate 80, the mixing tubes 74 may include a reduced diameter 104. The reduced diameter 104 and the axially concentric hole 102 in the fuel distribution plate 80 may collectively form an annulus 100 therebetween.

The annulus 100 may facilitate the distribution of fuel between the second chamber 92 and the first chamber 88.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A combustor assembly, comprising: one or more fuel plenums; one or more fuel distribution plates disposed within each of the one or more fuel plenums; and a plurality of mixing tubes disposed at least partially within each of the one or more fuel plenums and extending through the one or more fuel distribution plates; the plurality of mixing tubes each having an outer diameter and further comprising a portion having a reduced outer diameter smaller than the outer diameter, wherein each portion extends through at least one of the one or more fuel distribution plates to form respective radially annular passage therebetween.

2. The combustor assembly of claim 1, wherein each of the one or more fuel plenums comprise:

a first boundary plate;

a second boundary plate spaced apart from the first boundary plate; and an outer barrel disposed about the first boundary plate, the second boundary plate, and the one or more fuel distribution plates.

3. The combustor assembly of claim 2, further comprising a plurality of axially concentric holes within the first boundary plate, the one or more fuel distribution plates, and the second boundary plate.

4. The combustor assembly of claim 2, wherein the one or more fuel distribution plates are disposed between the first boundary plate and the second boundary plate to form two or more fuel chambers.

5. The combustor assembly of claim 4, further comprising a fuel source in communication with one of the fuel chambers.

6. The combustor assembly of claim 5, wherein the fuel source supplies a fuel to one of the fuel chambers, and wherein the fuel flows from one of the fuel chambers, through the radially annular passages, and into the other fuel chambers.

7. The combustor assembly of claim 1, wherein each of the plurality of mixing tubes each has a constant inner diameter.

8. The combustor assembly of claim 1, wherein the plurality of mixing tubes each comprise one or more orifices for a flow of fuel.

9. The combustor assembly of claim 1, wherein a flow of air enters the plurality of mixing tubes and mixes with a flow of fuel therein.

10. A fuel plenum, comprising: a first boundary plate; a second boundary plate spaced apart from the first boundary plate; one or more fuel distribution plates disposed between the first boundary plate and the second boundary plate to form two or more fuel chambers; an outer barrel disposed about the first boundary plate, the second boundary plate, and the one or more fuel distribution plates; and a plurality of mixing tubes disposed at least partially within the outer barrel and extending from the first boundary plate, through the one or more fuel distribution plates, and to the second boundary plate; the plurality of mixing tubes each having an outer diameter and further comprising portion having a reduced outer diameter smaller than the outer diameter, wherein each portion extends through at least one of the one or more fuel distribution plates to form respective radially annular passage therebetween.

11. The fuel plenum of claim 10, further comprising a plurality of axially concentric holes within the first boundary plate, the one or more fuel distribution plates, and the second boundary plate.

12. The fuel plenum of claim 10, further comprising a fuel source in communication with one of the fuel chambers.

13. The combustor assembly of claim 12, wherein the fuel source supplies a fuel to a first of the fuel chambers, and wherein the fuel flows from the first of the fuel chambers, through the radially annular passages, and into a second of the fuel chambers.

14. The combustor assembly of claim 10, wherein each of the plurality of mixing tubes each has a constant inner diameter.

15. The fuel plenum of claim 10, wherein the plurality of mixing tubes each comprise one or more orifices for a flow of fuel.

16. The fuel plenum of claim 10, wherein a flow of air enters the plurality of mixing tubes and mixes with a flow of fuel therein.

17. A method, comprising: assembling a fuel plenum comprising a first boundary plate, a second boundary plate spaced apart from the first boundary plate, and one or more fuel distribution plates disposed between the first boundary plate and the second boundary plate; machining a plurality of axially concentric holes within the first boundary plate, the one or more fuel distribution plates, and the second boundary plate; and positioning a plurality of mixing tubes within the plurality of concentric holes, the plurality of mixing tubes each having an outer diameter and further comprising a portion having a reduced outer diameter smaller than the outer diameter, wherein each portion extends through at least one of the one or more fuel distribution plates to form a respective radially annular passage therebetween.

18. The method of claim 17, further comprising:

flowing air into the plurality of mixing tubes; and flowing a fuel into the plurality of mixing tubes via a plurality of orifices.

* * * * *